US007789198B2

(12) United States Patent
Myers

(10) Patent No.: US 7,789,198 B2
(45) Date of Patent: Sep. 7, 2010

(54) SHOULDER SADDLE FOR CARRYING A STEPLADDER

(76) Inventor: Paul E. Myers, 283 Salem Creek Dr., Statesville, NC (US) 28625

( * ) Notice: Subject to any disclaimer, the term of this patent is extended or adjusted under 35 U.S.C. 154(b) by 265 days.

(21) Appl. No.: 11/397,173

(22) Filed: Apr. 4, 2006

(65) Prior Publication Data

US 2007/0227817 A1 Oct. 4, 2007

(51) Int. Cl.
*E04G 1/00* (2006.01)

(52) U.S. Cl. ..... 182/129; 224/265

(58) Field of Classification Search ..... 182/129; 224/265

See application file for complete search history.

(56) References Cited

U.S. PATENT DOCUMENTS 4,474,386 A * 10/1984 Kanemaki ..... 224/265
5,058,789 A * 10/1991 Piper ..... 224/265
5,207,364 A * 5/1993 Johnson ..... 224/264
5,342,272 A * 8/1994 Pittroff ..... 482/106
5,590,826 A * 1/1997 Endo ..... 224/264
5,593,145 A * 1/1997 Sprayberry ..... 269/3
5,620,234 A * 4/1997 Gunby ..... 297/482
6,189,752 B1 * 2/2001 Perry ..... 224/264
6,415,890 B1 * 7/2002 Tucker et al. ..... 182/129
6,685,069 B2 * 2/2004 Ladd ..... 224/265
6,786,371 B2 * 9/2004 Horneman ..... 224/264
7,276,653 B2 * 10/2007 Shimada ..... 84/421
2002/0046904 A1 4/2002 Richard ..... 182/129
2002/0189902 A1 12/2002 Nelson ..... 182/129

OTHER PUBLICATIONS

American Psychological Association (APA): slot. (n.d.). The American Heritage® Dictionary of the English Language, Fourth Edition. Retrieved Jul. 15, 2009, from Dictionary.com website: http://dictionary.reference.com/browse/slot.*

* cited by examiner

*Primary Examiner*—Katherine W Mitchell
*Assistant Examiner*—Candace L. Bradford
(74) *Attorney, Agent, or Firm*—K&L Gates, LLP

(57) ABSTRACT

A shoulder saddle for carrying a stepladder of the type having opposed, channel-shaped, side rails with spaced steps extending therebetween. A saddle block has a length no greater than the spacing between steps of the ladder and a width greater than the width of the ladder steps and has a top surface with a pair of spaced slots extending lengthwise therealong for receipt of the rail flanges. The bottom surface of the block is concave in lengthwise cross-section and has a layer of cushion material attached thereto. Relatively flat front and back portions are formed on the bottom surface beyond the concave cross-section to facilitate attachment of the cushion material.

5 Claims, 3 Drawing Sheets

SHOULDER SADDLE FOR CARRYING A STEPLADDER

FIELD OF THE PRESENT INVENTION

The present invention relates to a device for attaching to a stepladder to facilitate carrying the ladder, and more particularly to such a saddle that is shaped to seat on a person's shoulder for comfortable carrying of the ladder.

BACKGROUND OF THE PRESENT INVENTION

Fiberglass or metal stepladders are commonly formed with opposed channel-shaped side rails having bases defining the outer side rails of the ladder with inwardly projecting flanges between which the rungs or steps are mounted. In carrying such a ladder the arm of the person carrying the ladder extends through the space between opposing rails and the edges of the flanges of the side rails are supported on the shoulder of the person carrying the rail. As the flanges are relatively thin and the edges of the flanges are flat, the weight of the supported ladder on the curved top of the shoulder of the person carrying the rail is concentrated uncomfortably at very small contact locations.

To render the support of a ladder more comfortable and, therefore, more transportable over extended distances, ladder carrying devices or attachments have been devised for mounting on the side rails of stepladders with cushioned and/or curved shoulder engaging surfaces. These have various ways of attachment to ladders, such as velcro or clamping sides or other somewhat complicated means.

SUMMARY OF THE INVENTION

By the present invention, a shoulder saddle is provided for carrying a stepladder with an improved simple and reliable attachment to a stepladder. Briefly described, the shoulder saddle of the present invention is designed for carrying a stepladder of the type having opposed, channel-shaped, side rails that have spaced rungs extending therebetween with the bases of the channel-shaped side rails defining the outer side rails of the ladder and the flanges of the rails extending inwardly of the ladder. This saddle includes a saddle block having a length no greater than the spacing between the steps of the ladder and a width greater than the width of the ladder rail. A top surface of the block is formed with a pair of spaced slots extending lengthwise therealong at a spacing equivalent to the spacing of the rail flanges, with each slot being of a width greater than the thickness of the rail flanges for receipt of the rail flanges in the slots. The saddle block has a bottom surface for seating of the block and supported ladder on the shoulder of a person carrying the ladder.

This arrangement of spaced slots allows the saddle to be readily and effectively attached to a channel-shaped side rail of a stepladder and to be firmly set in place for effective and comfortable carrying of a ladder on a person's shoulder.

Preferably, the bottom surface of the saddle block is concave in lengthwise cross-section to facilitate seating and centering of the block and supported ladder on the convex surface of the shoulder of a person carrying the ladder. Also preferably, a layer of cushion material is attached to the concave bottom surface for cushioning support of the saddle block and ladder on the shoulder of the person carrying the ladder.

To facilitate attachment of a layer of cushion material to the bottom surface of the shoulder saddle, the bottom surface is formed with relatively flat front and back portions beyond the concave cross-section to facilitate attachment of the cushion material to the bottom surface.

DETAILED DESCRIPTION OF THE PREFERRED EMBODIMENT

Figure 1:
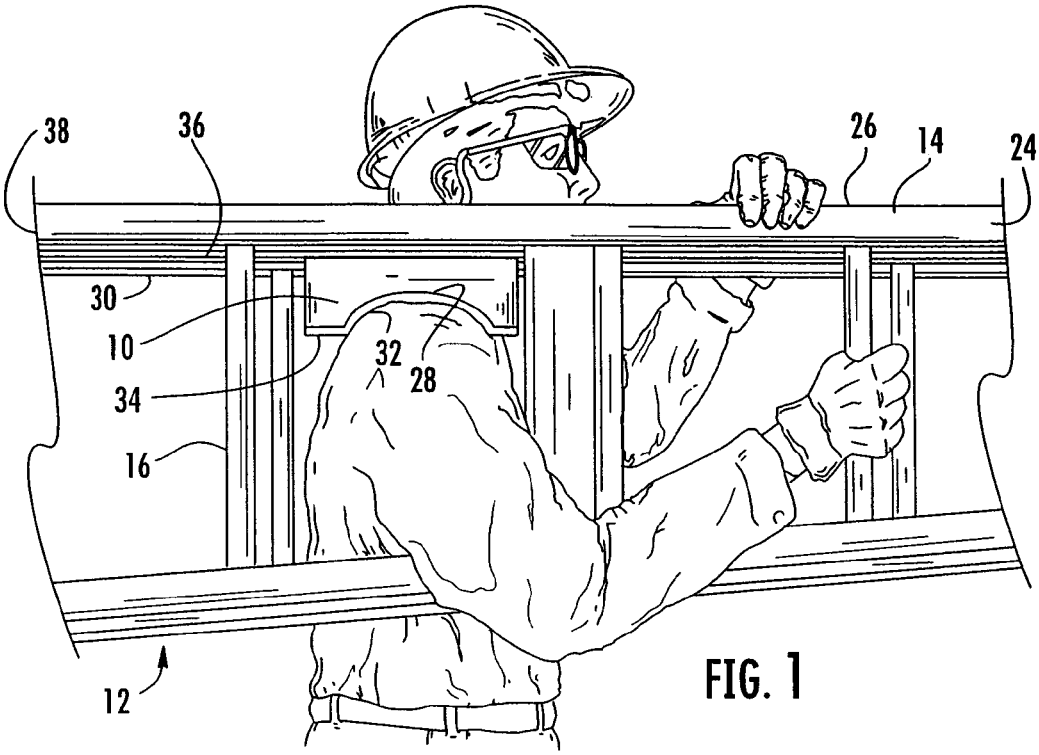
FIG. 1 is an elevational view showing a stepladder supported on the shoulder of a person carrying the ladder with a shoulder saddle of the preferred embodiment of the present invention.
Figure 2:
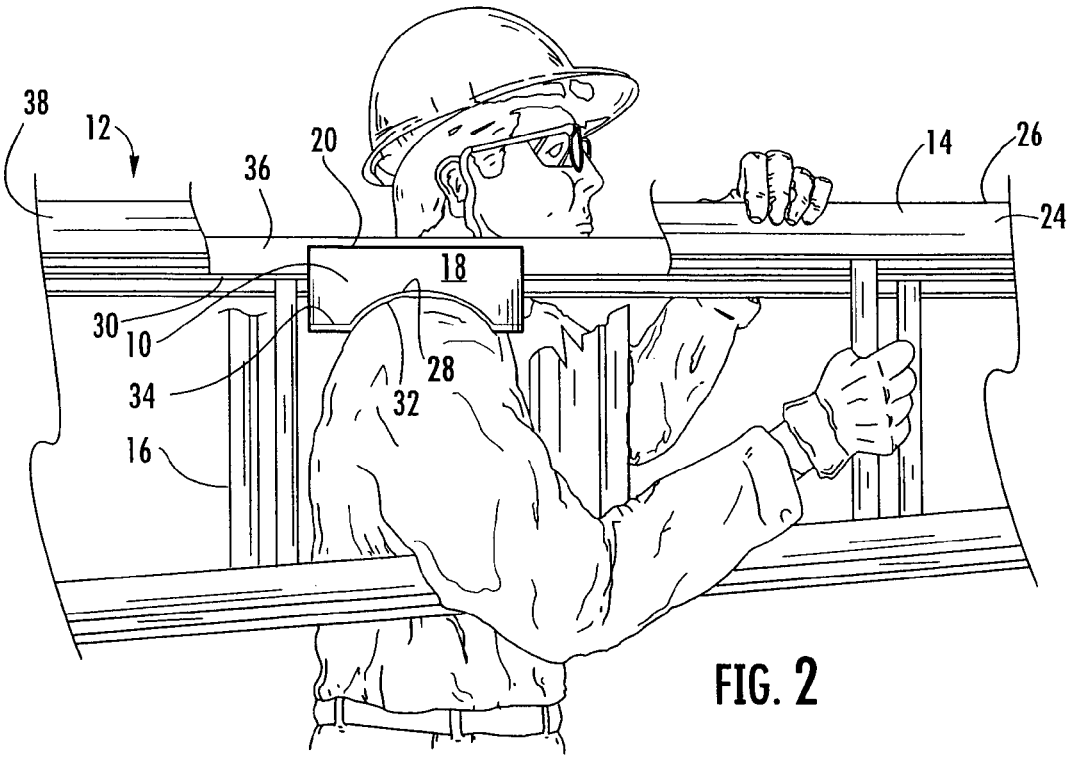
FIG. 2 is a view similar to FIG. 1 with a portion of the adjacent leg of the ladder broken away to illustrate the shoulder saddle in full view.
Figure 3:
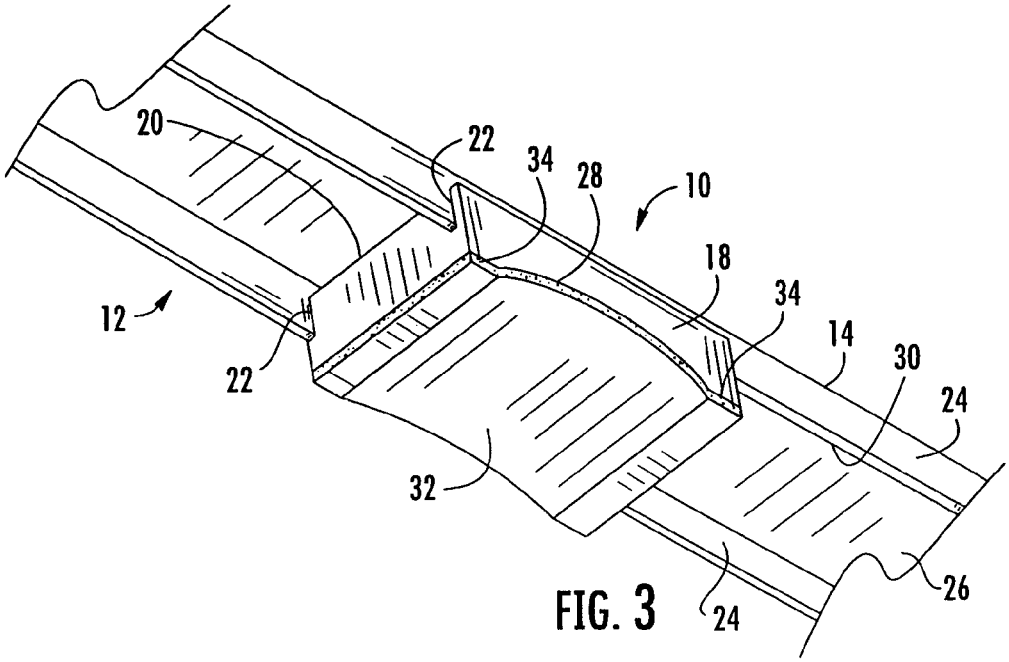
FIG. 3 is a perspective view looking at a portion of the underside of a ladder side rail with the shoulder saddle attached.
Figure 4:
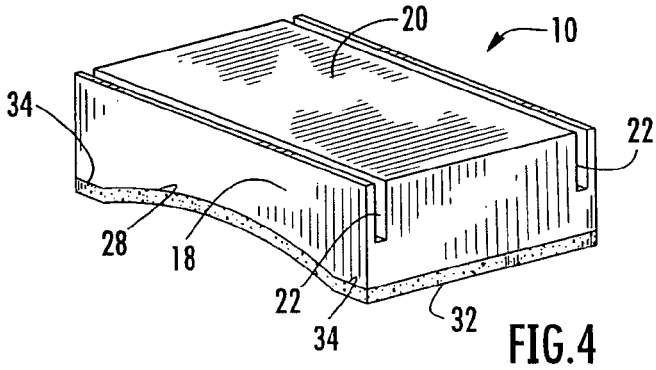
FIG. 4 is a side perspective view of the saddle of the preferred embodiment of the present invention.
Figure 5:
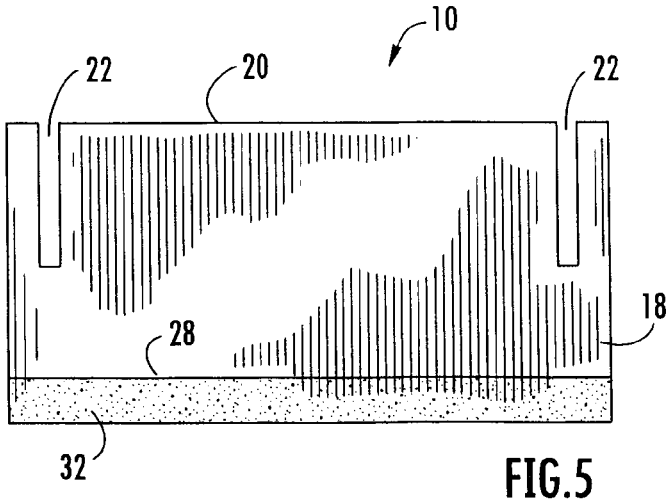
FIG. 5 is an end view of the saddle of the preferred embodiment of the present invention.
Figure 6:
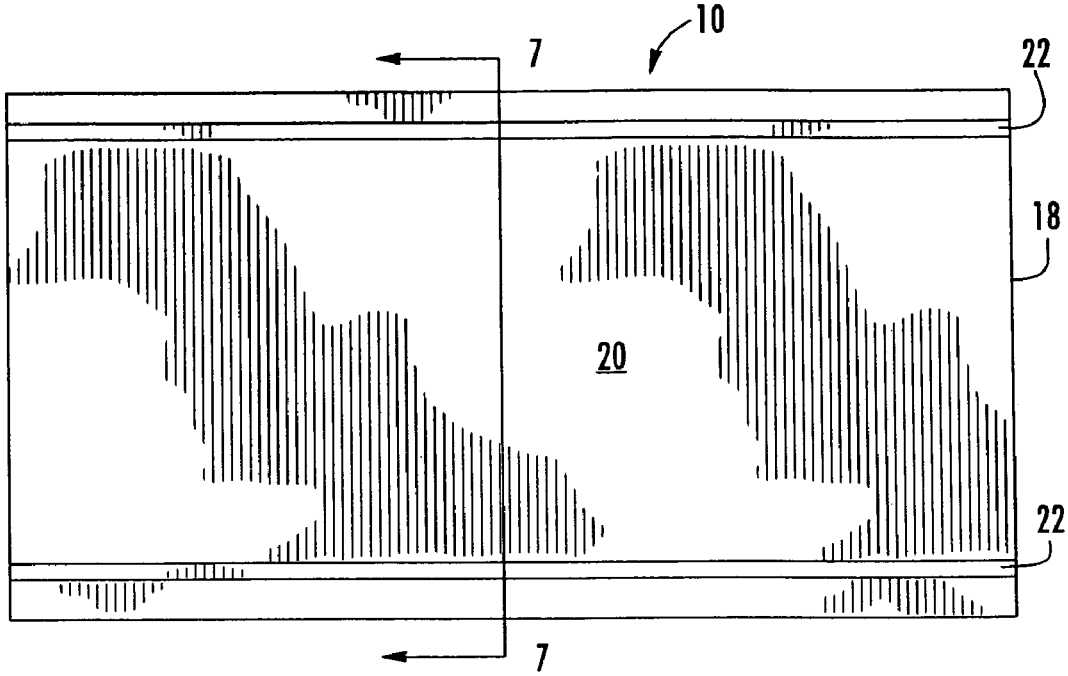
FIG. 6 is a top view of the saddle of the present invention.
Figure 7:
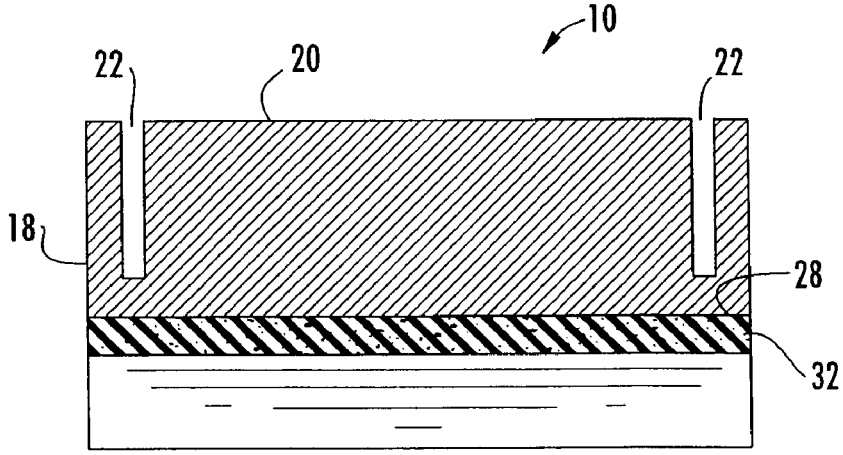
FIG. 7 is a vertical cross-sectional view of the saddle of the preferred embodiment of the present invention as viewed along line 7-7 of FIG. 6.

The preferred embodiment of the shoulder saddle 10 of the present invention is described with reference to the accompanying drawings. It is shown in FIGS. 1, 2 and 3 mounted on a stepladder 12 of the type having opposed channel-shaped side rails 14 with spaced steps or rungs 16 extending therebetween. The ladder may be of any manageable length, typically between 4 feet and 12 feet, and is commonly made of fiberglass or metal.

As seen in FIGS. 4, 5, 6 and 7, the shoulder saddle 10 is in the form of a saddle block 18 of rigid material, such as wood, plastic or metal, and is of a length no greater than the spacing between the ladder steps 16 so that it can be located at a central location on the ladder 12 between steps 16. Preferably it is sufficiently less in length than the space between steps so that it can be adjustably positioned for optimum balance of the ladder on the shoulder of a person carrying the ladder.

The saddle block 18 is of a width greater than the width of the ladder steps 16 to accommodate a pair of spaced slots 22 extending lengthwise therealong and fully from end to end of the block 18. These slots 22 are spaced apart equivalent to the spacing of side flanges 24 of the ladder side rails 14. These side flanges 24 extend inwardly from the bases 26 of the ladder side rails 14 with the bases 26 defining the outer surface of the ladder side rails 14.

The spaced slots 22 extend into the saddle block 18 a distance sufficient for stable mounting of the saddle 10 on the ladder side rails 14, preferably somewhat less than the depth of the channel-shaped side rails 14. Further, the slots 22 are of a width greater than, but preferably only slightly greater than, the thickness of the side flanges 24 so that the saddle block 18 can be easily, yet firmly, mounted on the side rails 14.

The ladder block 18 has a bottom surface 28 for seating of the block and supported ladder on the shoulder of a person carrying the ladder, as illustrated in FIGS. 1 and 2. This bottom surface 28 is preferably concave in lengthwise cross-section to facilitate seating and centering on the convex shape of the shoulder of a person carrying the ladder 12, which also distributes the weight of the ladder over a longitudinally and transversely extended area significantly greater than when the ladder is carried with the narrow, flat, inner edges 30 of the side flanges 24 directly supported on the shoulder of the person, carrying the ladder. Thus, the ladder 12 can be carried comfortably with the saddle a greater distance than when the ladder is carried without a saddle and where carrying must be stopped periodically to relieve the discomfort of the inner edges 30 of the side flanges 24 pressing into the shoulder of the person carrying the ladder.

For greater comfort, a layer 32 of cushion material is fixed to the concave bottom surface 28 of the saddle block 18. Typically this cushioning material layer 32 can be made of a dense plastic foam covered by a sheet of nylon or other suitable material. The layer 32 may be of any desired thickness, such as, for example, one-quarter inch or one-half inch or any other desirable thickness to provide selected comfort and protection.

In addition to the bottom surface 28 of the saddle block 18 being concave for complementary support on the shoulder of a person carrying the ladder, the bottom surface 28 is preferably further formed with relatively flat end portions 34 extending outwardly from the concave surface. These flat end portions 38 facilitate secure attachment of the cushion material layer 32 to the bottom surface 28 of the saddle block 18.

In FIGS. 1 and 2, the shoulder saddle 10 is shown mounted on a ladder 12 of the type that has two legs 36, 38 hinged together for folding outwardly in use and inwardly for carrying and storage. The shoulder saddle 10 is mounted at approximately the weight center of the ladder for easy balancing of the ladder on the shoulder of the person carrying the ladder. It is mounted on the leg 36 closest to the person carrying the ladder so that it can be seated fully on the person's shoulder when the arm of the person is inserted through the ladder between steps 16 with the side rail 14 to which the shoulder saddle 10 is mounted being the upper side rail with the ladder 12 hanging from the shoulder saddle.

Having the side flanges 24 of the side rail 14 received in the spaced slots 22 results in a firm, stable mounting for carrying of the ladder without undue displacement or wobbling of the ladder 12 on the shoulder saddle 10.

To minimize material and weight, the saddle block 18 may be made with a partial void between the spaced slots 22, although strength and stability would normally require some generally full height transverse extent of the top surface 20.

While the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be considered to limit the present invention or otherwise to exclude such other embodiments, adaptations, variations, modifications and equivalent arrangements, the present invention being limited only by the claims appended hereto and equivalents thereof.

What is claimed is:

1. In combination, a stepladder and a shoulder saddle for carrying the stepladder of the type having opposed, channel-shaped, side rails with spaced steps extending therebetween, the bases of the channel-shaped side rails defining the outer sides of the ladder with the flanges of the rails extending inwardly of the ladder, said saddle comprising:

a saddle block having a length of an extent allowing the block to be positioned between steps of a ladder that may be carried on the shoulder saddle and a width greater than the widthwise spacing of the flanges of a rail of a ladder that may be carried on the shoulder saddle;

said saddle block having an outermost top surface with a pair of spaced slots opening in said top surface inwardly of the widthwise extent of said surface and extending inwardly therefrom into said block, said slots extending lengthwise along said block such that a respective side rail flange fits in a respective slot so that the stepladder may be carried on the shoulder saddle; and said block having a bottom surface for seating of the block on the shoulder of a person when the block is being used for carrying a ladder.

2. The shoulder saddle of claim 1, characterized further in that said bottom surface of said block is concave in lengthwise cross-section for generally complementary seating on the shoulder of a person.

3. The shoulder saddle of claim 2, characterized further by a layer of cushion material attached to said concave bottom surface for cushioning support of the block on a shoulder of a person.

4. The shoulder saddle of claim 3, characterized further in that said bottom surface has relatively flat front and back portions beyond said concave cross-section to facilitate attachment of said cushion material to said bottom surface.

5. The shoulder saddle of claim 1, characterized further by a layer of cushion material attached to said concave bottom surface for cushioning support of the block on a shoulder of a person.

* * * * *